US007275401B1

(12) United States Patent
Zimmerman

(10) Patent No.: US 7,275,401 B1
(45) Date of Patent: Oct. 2, 2007

(54) KEY SWITCH WITH AT LEAST ONE SWITCHING POSITION

(75) Inventor: Rudolf Zimmerman, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/403,319

(22) Filed: Apr. 13, 2006

(51) Int. Cl.
*E05B 17/04* (2006.01)
*E05B 27/00* (2006.01)

(52) U.S. Cl. ..... 70/379 R; 70/360; 70/380; 70/422

(58) Field of Classification Search ..... 70/379 R, 70/380, 251–252, 360, 422; 200/43.05
See application file for complete search history.

(56) References Cited

U.S. PATENT DOCUMENTS 2,679,557 A * 5/1954 Miller ..... 200/11 C
3,123,995 A * 3/1964 Russell et al. ..... 70/477
3,541,820 A * 11/1970 Best ..... 70/369
3,659,444 A * 5/1972 Wellekens ..... 70/360
4,558,193 A * 12/1985 Test ..... 200/43.08
4,634,822 A * 1/1987 Goeke ..... 200/43.08
4,639,562 A * 1/1987 Fredrickson ..... 200/43.08
4,759,204 A * 7/1988 Neyret ..... 70/360
5,265,453 A * 11/1993 Konii et al. ..... 70/379 R
5,732,580 A * 3/1998 Garnault et al. ..... 70/422
6,446,475 B1 * 9/2002 Agnatovech et al. ..... 70/379 R
6,711,924 B2 * 3/2004 Ritz ..... 70/422

FOREIGN PATENT DOCUMENTS

EP 0 483 048 B1 4/1992

* cited by examiner

*Primary Examiner*—Brian E. Glessner
*Assistant Examiner*—Alyson M. Merlino

(57) ABSTRACT

The invention relates to a key switch with at least one turn-key switching position comprising a cylindrical lock adapted to perform a translation upon key authorization. The aim is to present a key switch being capable of allowing key hierarchies as well as the withdrawal of the key in particular switching positions. For this purpose the key switch also comprises a lock holder adapted to host the translation of a cylindrical lock in respect to the lock holder along a common rotational axis and the cylindrical lock being form-locking with the lock holder for rotations around the rotational axis. The user is able to employ the turning key movement for the selection of a switching position and an outward and inward linear translation of the key to lock or unlock a switching position.

7 Claims, 4 Drawing Sheets

KEY SWITCH WITH AT LEAST ONE SWITCHING POSITION

FIELD OF THE INVENTION

The invention relates to a key switch with at least one switching position comprising a cylindrical lock adapted to perform a translation upon key authorization.

BACKGROUND OF THE INVENTION

The above described type of key switch finds manifold applications in combination with control and switching devices.

Several of these applications may be found in the industrial and the private sector. In general the control or switching device has an authorization mechanism based on a key lock. Possible private applications are key switches to authorize a closing and opening of automated garage doors or the enabling or disabling of the elevator service for certain floors of a building, for example. Possible industrial applications are, for example, control and switching devices as integrated units of machines or production lines.

SUMMARY OF THE INVENTION

In most of the mentioned applications it is favorable to assign a number of key positions to the respective switching states of the associated control or switching device. In case of a turn-key lock the possible turning angles of the key would correspond to the respective switching states. It is also desirable to enable the turn-key lock to release the key in the appropriate key positions to allow or prevent the withdrawal of the key. In particular, the market demands the additional option to allow the withdrawal of the key in dependence on the appropriate key authorization.

Up to now the key positions, which are enabled for key withdrawal, are based on the employment of multiple pin rows. For every key position enabled for key withdrawal another set of pin row(s) is required, which increases complexity of the lock. Unfortunately, the complexity scales with the number of desired switching states.

Furthermore it is desired to enable a hierarchical locking/closing mechanism, which is typically set forth by using multiply divided pins. Such a locking system allows the definition of keys bearing the authorization for a selectable number of locks. As a result, the key bearer can exercise his authorization for any lock of the locking system with only a single key. This way it is also possible to define general keys, master keys or group keys, where each key allows the bearer to change in between switching states of technical devices to which he is authorized to. This may also include the access to certain working areas of a technical machine or device, which is secured by the control or switching device.

A key switch based on the known technology combining a hierarchical locking system with the option to withdraw the key from multiple key positions is consequently extremely complex and wasteful. If both features are to be combined the user has to accept major drawbacks which result in reduced functional security or substantial inconveniencies during use. With today's technology and substantial mechanical effort it may be possible to use multiple pin rows in a hierarchical locking system in order to simultaneously enable the key withdrawal in certain key positions. However, this system would require a high number of mechanical parts and increases substantially in dimension. As a matter of fact, such a system would become extremely complex and costly.

From the document EP 0 483 048 B1 an automotive ignition switch with a "key-in-warning" safety switch inner to the ignition switch is known. The said ignition switch does not require the necessity of an independent switch for the "key-in-ignition" warning circuit. Both switching circuits are integrated into each other and therefore one less mounting to design, translates into a saving in both material and design cost.

It is one object of the present invention to create a key switch of a simple and cost-effective design supporting key hierarchies and key switch positions with the option to withdraw the key.

According to one aspect of the present invention, a key switch with at least one switching position comprising a cylindrical lock adapted to perform a translation upon key authorization, a lock holder adapted to host the translation of the cylindrical lock in respect to the lock holder along a common rotational axis and the cylindrical lock being form-locking with the lock holder for rotations around the rotational axis, a first washer with at least one inner notch, a second washer with at least one tab adapted to fit into the inner notch of the first washer, the tab being moveable into or out of the first washer upon translation of the cylindrical lock along the rotational axis and when located outside the first washer being rotatable around the rotational axis in conjunction with the rotation of the cylindrical lock.

The invention is based on a key switch with at least one switching position. The key switch includes a cylindrical lock which is adapted to perform a translation upon key authorization. Furthermore the cylindrical lock is hosted by a lock holder to promote the translation once the translation is authorized. The authorization function is based on pin rows, which are located inside the cylindrical lock.

An important feature of the invention is the fact that the cylindrical lock is form-locking with the lock holder and a second washer in respect to rotational movements around a rotational axis. When the key switch is in a switching position a rotational movement of the cylindrical lock is blocked by a tab of the second washer being located in an inner notch of an immovable first washer. For this purpose the first washer may be designed to be form-locking with another holder or holding apparatus of the key switch.

In order to change the key switch from one switching position to another the key has to be inserted into the cylindrical lock. After authorization of the key the translation along the rotational axis is enabled. Once the user has finished performing said translation by sliding the cylindrical lock along the common rotational axis, the tab of the second washer adapted to fit into the inner notches of a first washer is moved parallely along the rotational axis. After the translation caused by the user the tab of the second washer is located outside the inner notch of the first washer with the effect that the notch no more retains the tab. In other words the cylindrical lock, the key and the second washer are enabled to be rotated around the rotational axis. By turning the key other switching positions are selectable.

Provided that the position of the tab of the second washer allows an insertion into another inner notch of the first washer, corresponding to another switching position, a counter-movement into the opposite direction is enabled. The counter-movement is performed either by a pulling action by the user or a springing action of an elastic element counteracting the direction of the translation. After placing the tab of the second washer inside the other notch of the first washer the key switch is changed to another switching position.

It is advantageous to encounter the translation of the cylindrical lock caused by the user with an elastic or a spring-like element to initiate a convenient counter-movement or counter-translation once the switching position is selected. The user is simply required to release the grip of the key in order to lock the respective switching position.

It is possible and advantageous to design a number of inner notches into the first washer. The number of the inner notches determines the number of switching positions of the key switch. The position of the inner notches is of importance to allocate the key switching positions.

Furthermore it is advantageous to allocate external notches on the first washer, which are designed in order to allow defined positions of the first washer inside a housing or holding apparatus of the key switch and/or control device. Like this it is possible to change the key switch positions according to the respective application or device without having to produce multiple types of the first washer bearing inner notches at different positions. The external notches furthermore give rise to a flexibility to change the position of the first washer in dependence on the application. In view of this advantage it is appropriate to choose a symmetric distribution of external notches to support a gradual turning possibility of the first washer. An asymmetric distribution of external notches may be used to disable undesired positioning of the first washer.

Interestingly enough it is possible to allow the withdrawal of the key once a chosen switching position is locked. In other words, the key may be withdrawn from the cylindrical lock once the tab of the second washer is at least partially placed inside the first washer. Since the lock holder and the cylindrical lock are turned the same pin rows or pin arrangements can be used to authorize the inserted key at any desired switching position.

Advantageously the second washer and/or the cylindrical lock may be connected to an electromechanical switching unit. In this context it may be particularly advantageous to allow switching upon performance of the counter-movement of the tab of the second washer into the first washer. It might also be of interest to also detect the state while the switching position is being changed. For example, there are machines that require to be stalled while the switching position is being changed. In this case the change of the switching position also needs to be detected for appropriate switching action of the electromechanical switching unit.

Another advantage results from the fact that the switching positions, which correspond to certain switching states, can be visually detected from the key position in the lock. Furthermore it is possible to use more than one pin rows or pin arrangements or at least partly divided pins, in order to allow key hierarchies. Hence the key switch represents a technically elegant, user-friendly, cost-effective and safe solution for key switch applications in many scenarios.

The employment of multiple pin rows or pin arrangements may still be used to increase the lock safety. For matters of safety or other related matters it might be desired to disallow the withdrawal of the key in certain switching positions. Hence it is favorable to lock the key inside the cylindrical lock. For this purpose a locking mechanism may be used, which can be located within the lock holder being also subject to the rotation when selecting a switching position.

BRIEF DESCRIPTION OF THE DRAWINGS

The following figures contain a preferred embodiment of the invention indicating additional advantages of such.

DETAILED DESCRIPTION OF THE INVENTION

Figure 1:
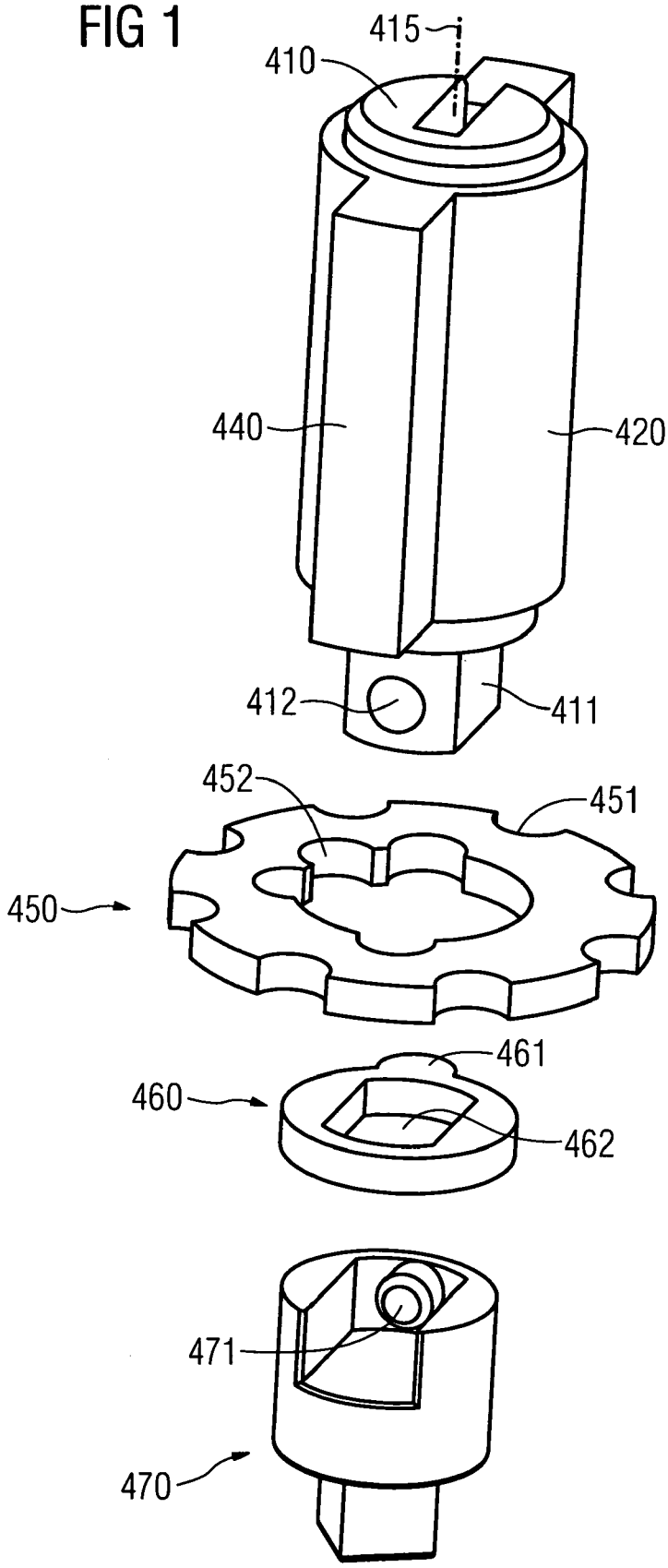
FIG. 1 is a view of disassembled essential parts of a key switch.

FIG. 1 is a view of disassembled essential parts of a key switch. The essential parts of the key switch are located along the rotational axis 415. The essential parts are the cylindrical lock 410 being located inside the lock holder 420, the first washer 450, the second washer 460 and an adapter 470. The joint linear translation of the cylindrical lock 410, the second washer 460 and the adapter 470 are designed to be form-locking for rotations as well as linear translations. The cylindrical lock 410 slides linearly inside the lock holder 420 and is connected to the adapter 470 using a hole 412 to be engaged into the bolt 471 of the adapter 470. The second washer 460 is designed to be placed onto the extremity 411 of the cylindrical lock 410. Furthermore is the clearing 462 of the second washer 460 designed to be form-locking upon rotation around the rotational axis 415. When assembled the adapter 470 is engaged with the extremity 411 and its bolt 471 is inserted inside the hole 412 of the cylindrical lock 410. The second washer 460 is fixed by the allocation of adapter 470 on the extremity 411 between the lock 410 and the adapter 470.

The lock holder 420 is form-locking in respect to the cylindrical lock 410 for rotations around the rotational axis 415. However, since the cylindrical lock 410, the second washer 460 and the adapter 470 are also form-locking upon translation the rotational movement of said parts is blocked by the first washer 450. When a switching position is locked the second washer 460 is located inside the first washer 450. The blocking is achieved by a tab 461 of the second washer 460 being placed inside an inner notch 452 of the first washer 450. The first washer 450 is not moved, since it is form-locking with the housing or a holding apparatus. When the cylindrical lock 410 is moved down the rotational axis 415 it causes the second washer 460 to move out of the first washer 450. Once the second washer 460 is located outside the first washer 450 rotational movements around the rotational axis 415 are enabled. The cylindrical lock 410, the lock holder 420, the second washer 460 and the adapter 470 take part in the rotation around the rotational axis 415. With the rotation of the cylindrical lock 410 the user changes (when acting on the key) the switching position of the key switch. By choosing a particular turn-key position the user decides for the respective switching position. The chosen switching position is allowed if the tab 461 finds a respective inner notch 452 inside the first washer 450. The linear counter-movement of the second washer 460 may be promoted by an elastic element, such as a spring (not shown in the figures). In order to lock switching position the user is simply required to release the key inside the cylindrical lock 410.

The adapter 470 may be used to directly act on the electromechanical switching unit, which is not shown in the figures. There could be a detection mechanism to detect the rotation and/or the translation. The rotational position will be relevant in terms of the chosen switching position and the longitudinal position is relevant in terms of whether the switching position is being changed or not. In dependence on the application both detection mechanisms might be of interest.

In the housing 440 of the locking mechanism is attached to the lock holder 420 and hosts a locking mechanism, which blocks or allows the pulling out of the key at particular switching positions.

In this embodiment of the invention the first washer 450 has four inner notches 452, which allow for four possible switching positions. Three notches 452 are located in close proximity, and may be used to represent three switching states of a conveyor belt each of them representing another speed of the conveyor belt. The forth inner notch 452 may be used for the conveyor belt's "off"-state.

The external notches 451 are symmetrically spaced around the circumference of the first washer 450. These allow for eight possible positions of the first washer 450. In case that the key switch is not straightforwardly installable into a control device the proper choice of one of the eight positions may be used to properly align the turn-key positions for optimal use. For the sake of clarity and user safety it might be appropriate to align the first washer 450 in such a way that the key-position for the "off"-state is aligned vertically in respect to the user.

Figure 2:
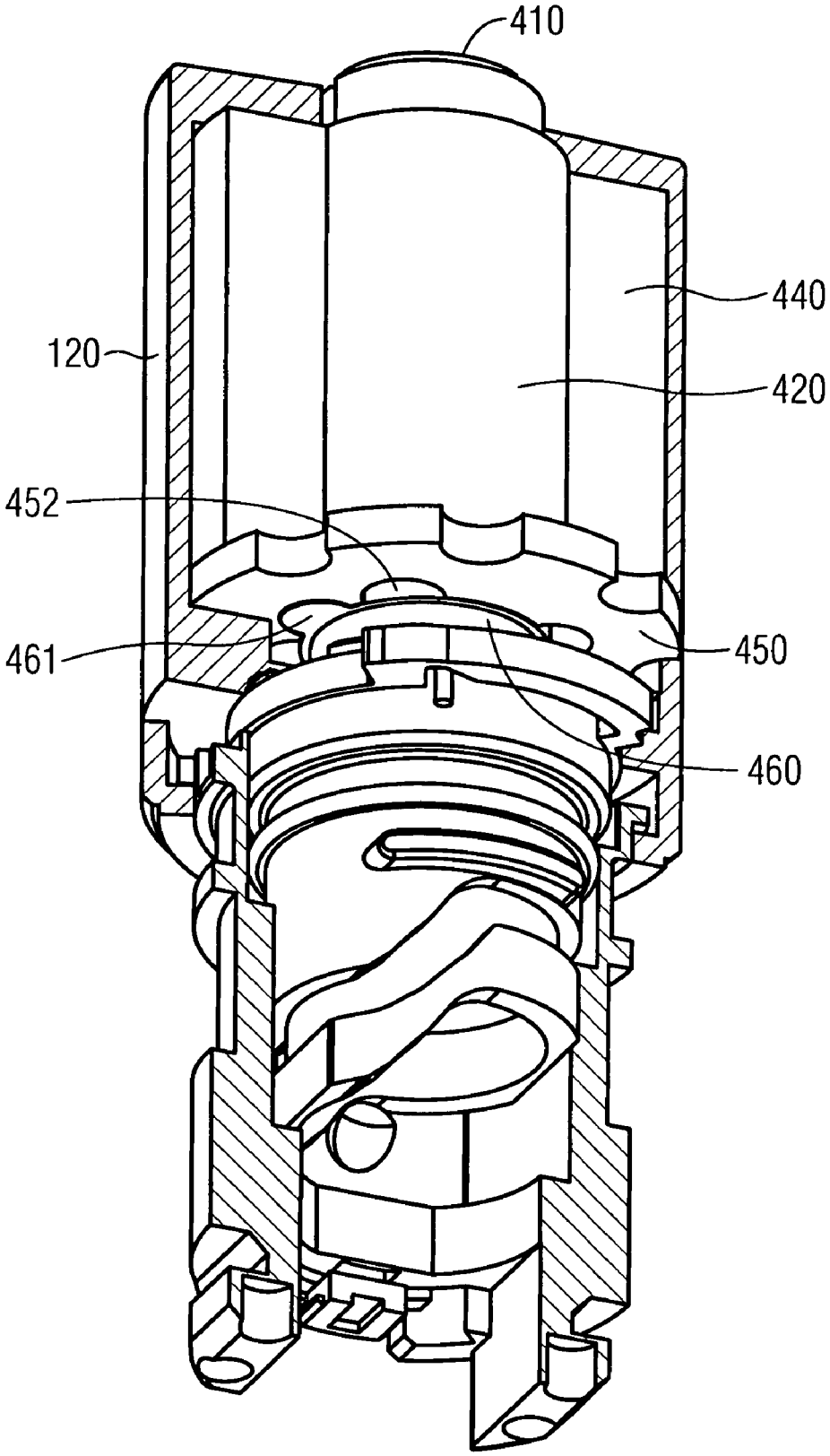
FIG. 2 is a first partly sectional view of the key switch in a first switching position.

FIG. 2 is a partly sectional view of said key switch in a first switching position. The parts shown in FIG. 1 are shown inside a sectional housing being in functional interaction with each other. The second washer 460 is located inside the first washer 450. The key switch is locked in a previously chosen switching position. Note that for this purpose the tab 461 is placed in an inner notch 452 of the first washer 450. The cylindrical lock 410 is in an outward position ready to receive a key.

As said before the first washer 450 is adapted to be form-locking upon any movement with the housing 120, which is shown as a sectional part in order to allow the view upon the essential parts of the key switch. The lock holder 420 together with the housing of the locking mechanism 440 is enabled to be rotated inside the cylindrically shaped housing 120.

Figure 3:
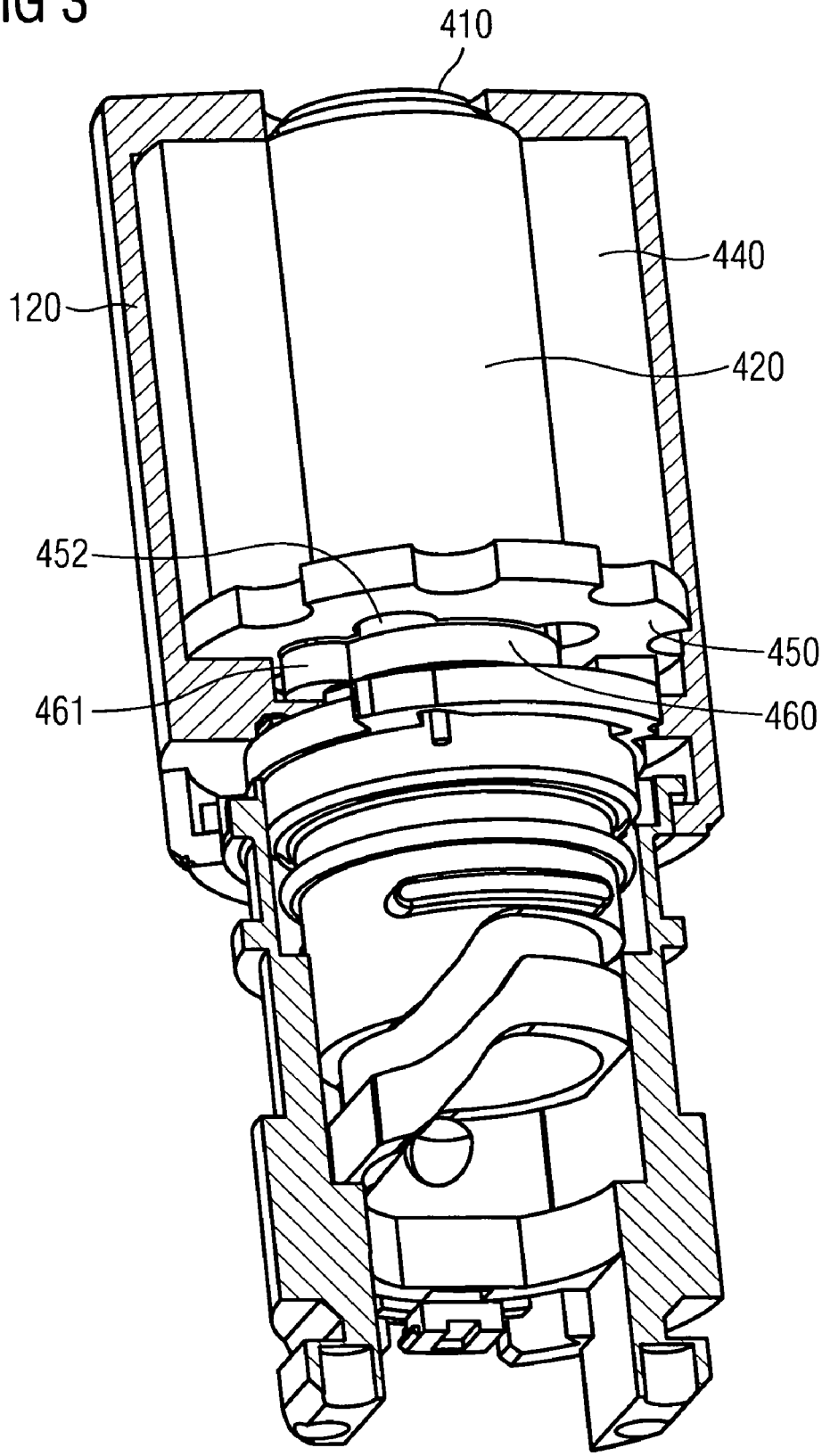
FIG. 3 is a second partly sectional view of the key switch while changing switching positions.

FIG. 3 is a second partly sectional view of the key switch while changing switching position. The tab 461 of the second washer 460 has been moved outside the inner notch 452 of the first washer 450. This is due to the second washer 460 being form-locking with the cylindrical lock 410, which has been moved along the rotational axis 415 down into an inward position. The inward position can only be accessed by previous authorization using a key, which is not shown here. Using the key the cylindrical lock 410 including the tab 461 can be rotated in order to be guided into another inner notch of the first washer 450. As long as the cylindrical lock 410 is in the inward position and hence the second washer 460 is located outside the first washer 450, the cylindrical lock 410 and the second washer 460 are jointly moveable around the rotational axis 415 enabling the user to choose any desired switching position.

Figure 4:
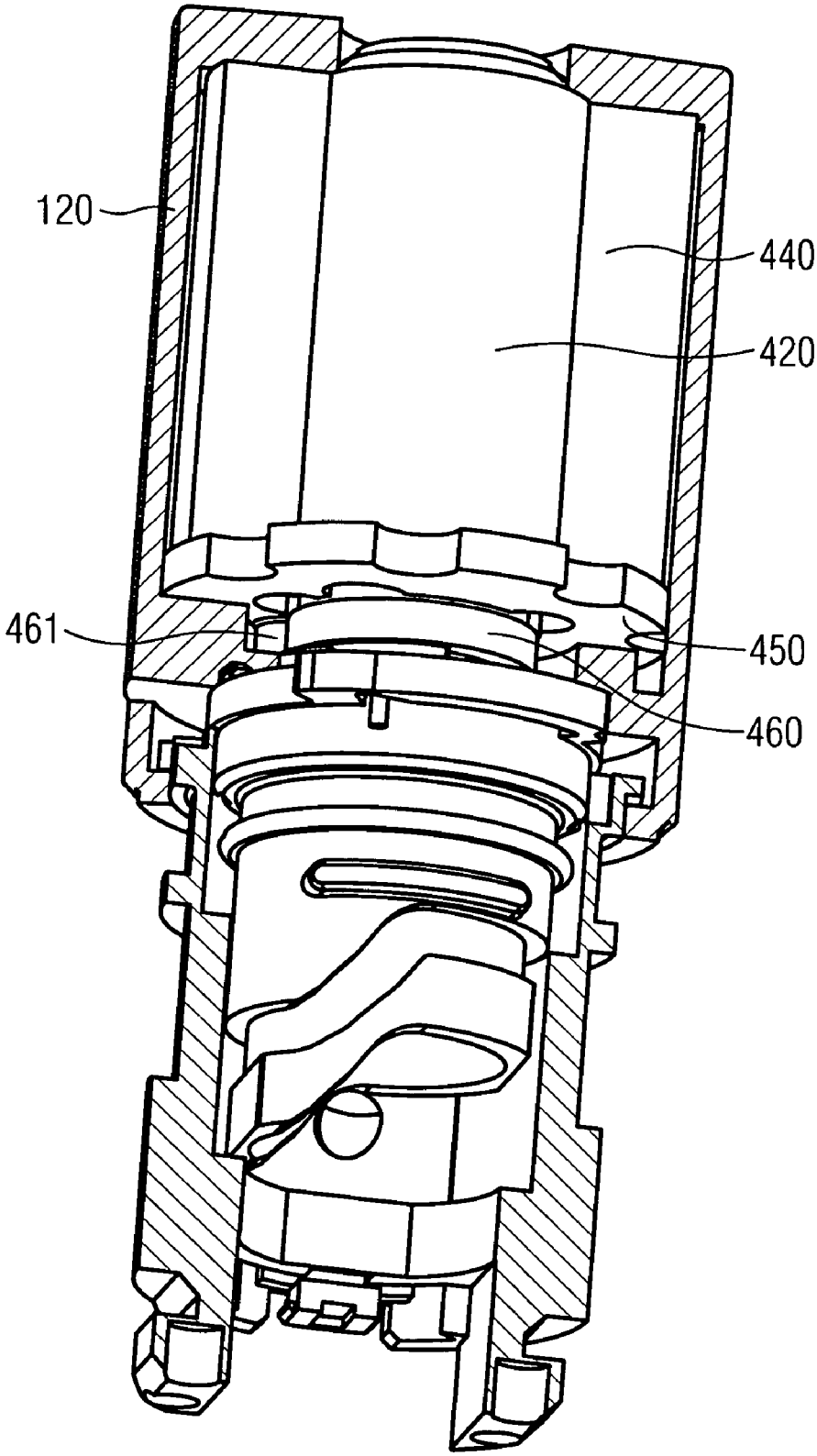
FIG. 4 is a third partly sectional view of the key switch while changing switching position and before locking into a second switching position.

FIG. 4 is a third partly sectional view of the key switch while changing switching position and before locking into a second switching position. The second washer 460 is located outside the first washer 450 still allowing the rotation to take place. If compared to the previous figure, the tab 461 has been moved rotationally away from the viewer. The tab 461 encounters another inner notch 452 and can be placed there by either actively pulling out the key or an elastic mechanism which becomes active upon releasing the key.

In summary, this invention concerns a key switch with at least one turn-key switching position comprising a cylindrical lock adapted to perform a translation upon key authorization. The aim is to present a key switch being capable of allowing key hierarchies as well as the withdrawal of the key in particular switching positions. For this purpose the key switch also comprises a lock holder adapted to host the translation of a cylindrical lock in respect to the lock holder along a common rotational axis and the cylindrical lock being form-locking with the lock holder for rotations around the rotational axis. The user is able to employ the turning key movement for the selection of a switching position and an outward and inward linear translation of the key to lock or unlock a switching position.

The invention claimed is:

1. A key switch having at least one switching position, the key switch comprising:

a cylindrical lock configured to be translated upon authorization of a key;

a lock holder configured to host the translated cylindrical lock, the cylindrical lock translated along a rotational axis common to the cylindrical lock and the lock holder, wherein the cylindrical lock engages in a form fit with the lock holder when the cylindrical lock is rotated about the rotational axis;

a first washer having at least one inner notch; and a second washer having at least one tab sized and configured to:

fit into the inner notch;

be moved into or out of the first washer when the cylindrical lock is translated along the rotational axis; and to be rotated together with the cylindrical lock about the rotational axis when the tab is located outside the first washer and the cylindrical lock is rotated;

wherein the key switch has a number of switching positions, and the first washer has a number of inner notches corresponding to the number of switching positions; and wherein the first washer is configured to change a position of the inner notches relative to a housing accommodating the key switch or to a holding mechanism for supporting the key switch.

2. The key switch according to claim 1, further comprising a housing for accommodating the key switch or a holding mechanism for supporting the key switch, wherein the first washer has at least one external notch sized and configured to engage with the housing or the holding mechanism.

3. The key switch according to claim 1, wherein the key switch is configured to receive the key by the cylindrical lock, wherein the received key is removable from the cylindrical lock only if the second washer is at least partially located inside the first washer.

4. The key switch according to claim 1, wherein the key switch has a number of switching positions, and the first washer is configured to determine the number of switching positions or respective physical locations of the switching positions.

5. The key switch according to claim 1, wherein the switching position is locked or unlocked by translating the second washer respectively into and out of the first washer respectively.

6. The key switch according to claim 1, further comprising an electromechanical switching unit connected to the second washer and/or the cylindrical lock.

7. The key switch according to claim 1, further comprising an elastic element configured to counteract against a translation of the cylindrical lock for locking the switching position.

* * * * *